United States Patent [19]

Noblanc et al.

[11] 4,158,516

[45] Jun. 19, 1979

[54] PLATFORMS RESTING ON AN UNDERWATER STRUCTURE

[75] Inventors: Alain G. N. Noblanc; Claude P. Valenchon, both of Paris, France

[73] Assignee: Compagnie Generale pour les Developpements Operationnels des Richesses Sous-Marines "C.G. Doris", Paris, France

[21] Appl. No.: 881,692

[22] Filed: Feb. 27, 1978

[30] Foreign Application Priority Data

Mar. 3, 1977 [FR] France ..... 77 06206
Apr. 5, 1977 [FR] France ..... 77 10232

[51] Int. Cl.[2] ..... E02B 17/00; E02D 27/52

[52] U.S. Cl. ..... 405/196; 405/200; 405/203; 405/204

[58] Field of Search ..... 61/86, 87, 88, 90, 91, 61/92, 96, 97, 100, 50; 175/7, 8, 9

[56] References Cited

U.S. PATENT DOCUMENTS 2,960,833 11/1960 Hayward ..... 61/92
4,060,995 12/1977 Lacroix ..... 61/97

FOREIGN PATENT DOCUMENTS 2461685 7/1976 Fed. Rep. of Germany ..... 61/97
7400895 8/1974 Netherlands ..... 61/90

*Primary Examiner*—Jacob Shapiro
*Attorney, Agent, or Firm*—Neil F. Markva

[57] ABSTRACT

A platform comprises a base structure designed to rest on the bottom of the sea for supporting an industrial or scientific installation above the surface of the water. The base structure comprises a floatable device capable of keeping afloat and means for ballasting the base structure to install the structure on the bottom of the sea. The base structure also includes a shaft in which a hollow element with a water-tight peripheral wall and a water-tight lower end wall, can slide vertically. The element can be temporarily fixed to the shaft. The element forms a float capable of supporting a deck which carries the installations, but is capable of being immersed over at least the greater part of its height. The deck is capable of floating until it is over the top of the element when the element is immersed and has means for fixing it to the top of the element.

21 Claims, 16 Drawing Figures

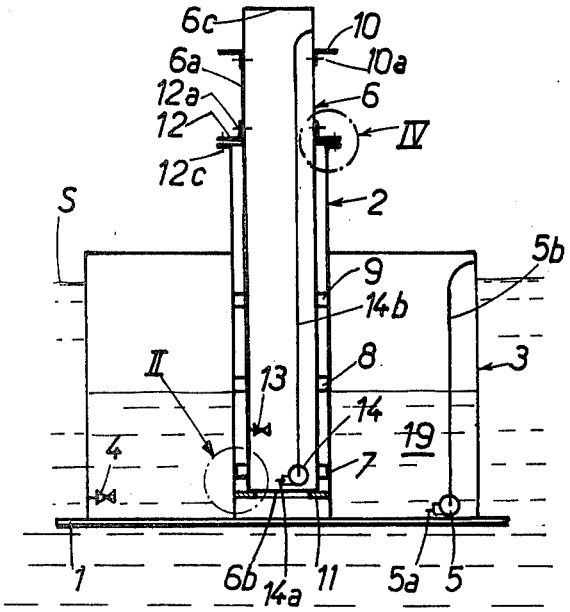
FIG.: 1
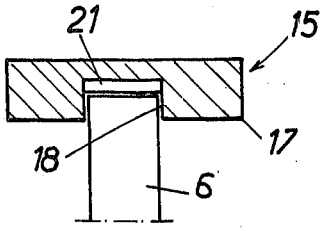
FIG.: 7
FIG.: 5
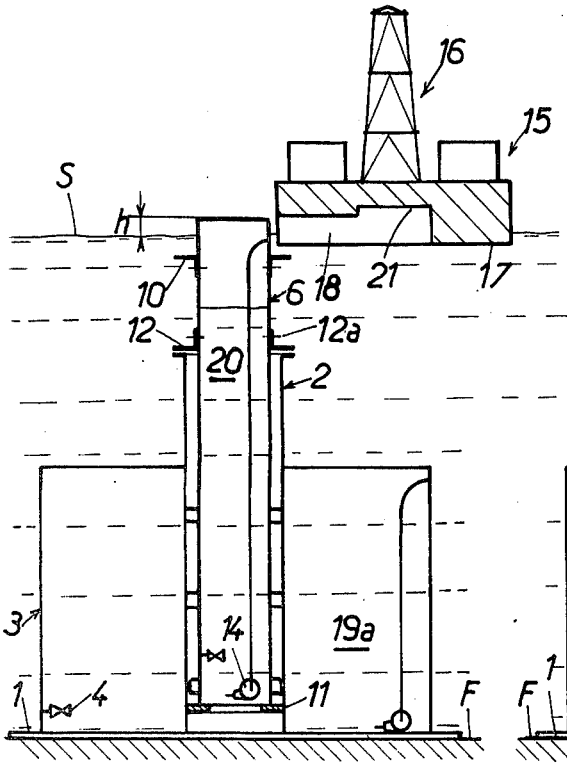
FIG.: 6
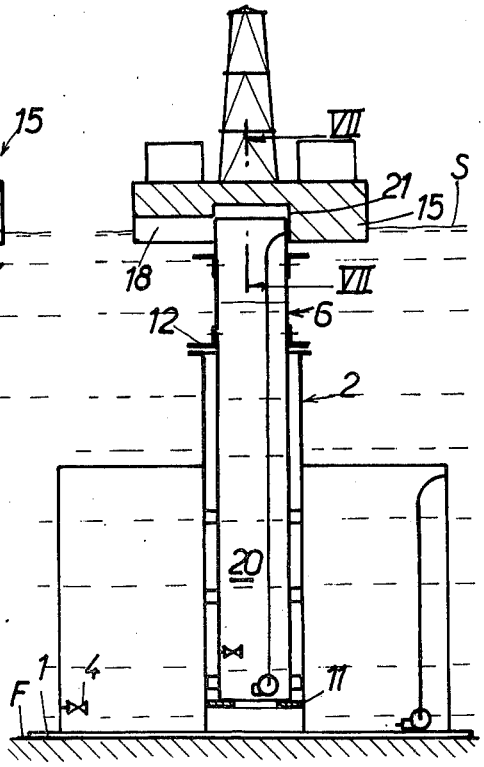

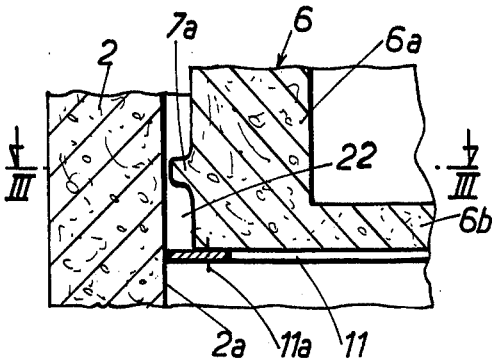
FIG.:2
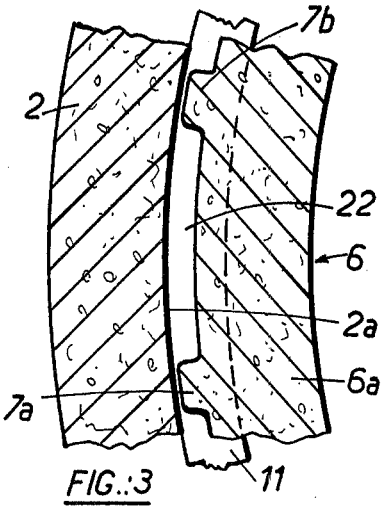
FIG.:3
FIG.:8
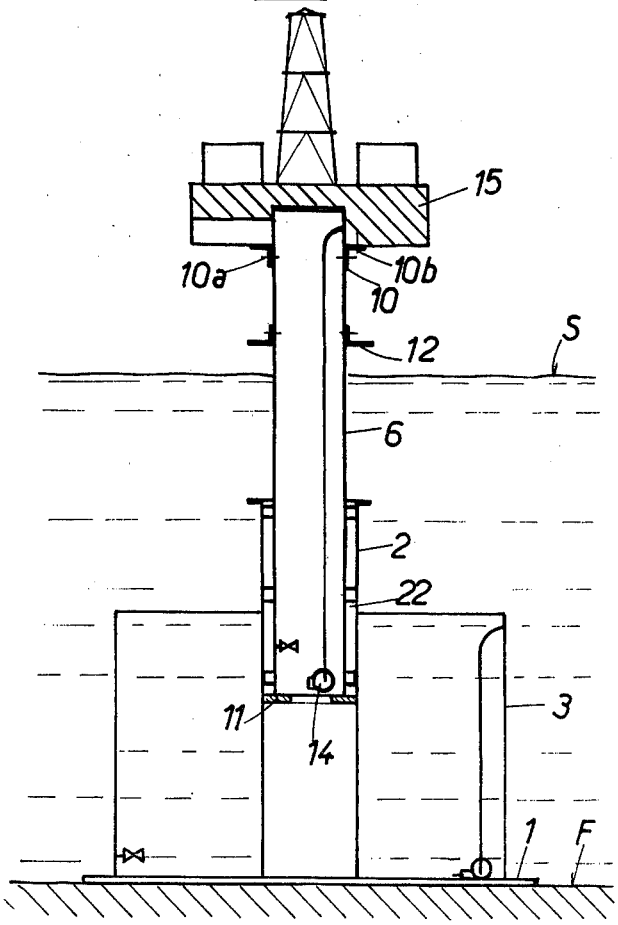

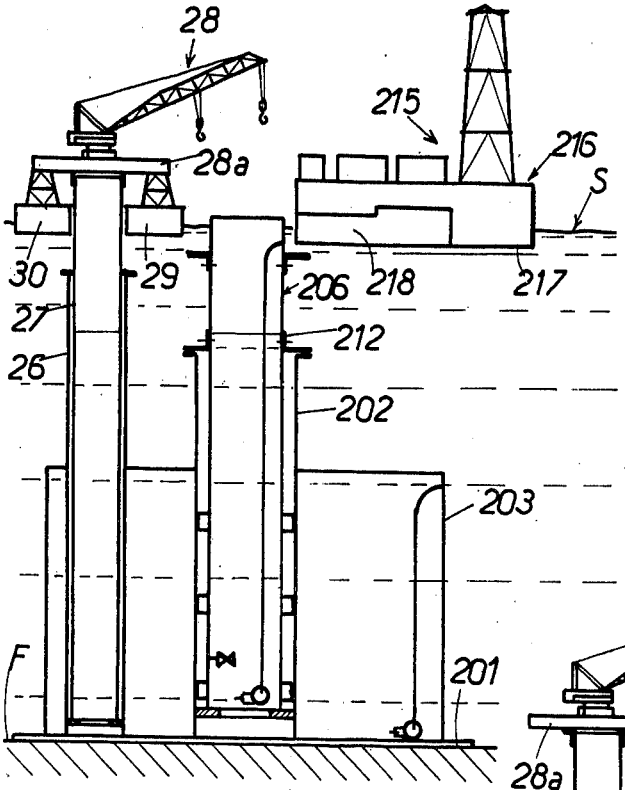
FIG.: 11
FIG.: 12
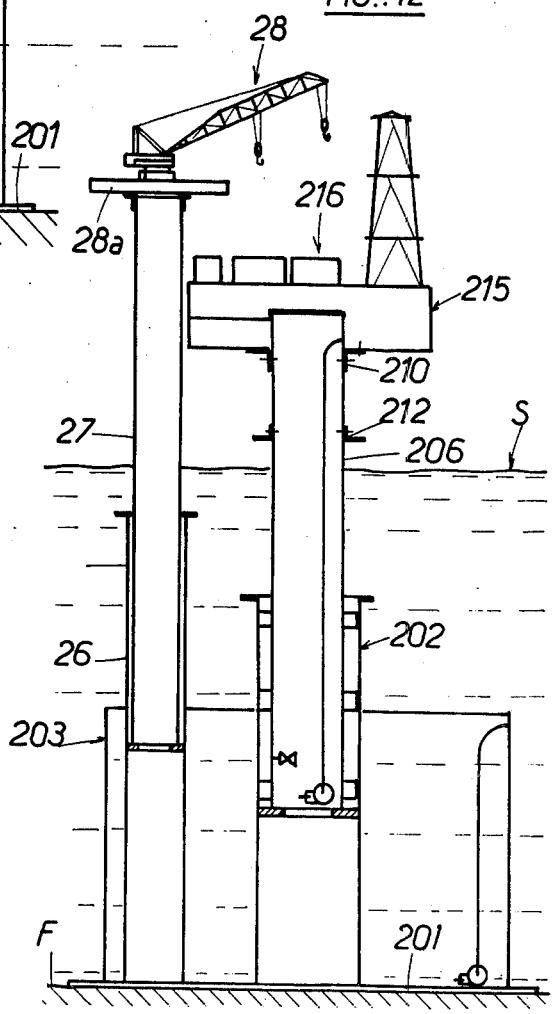

PLATFORMS RESTING ON AN UNDERWATER STRUCTURE

BACKGROUND OF THE INVENTION

The invention relates to platforms comprising a base structure resting on the sea bed or on the bottom of a body of water for supporting industrial or scientific installations, for example oil drilling or producing installations, above the surface of the water. More particularly, it relates to a platform of the so-called "weight platform" type having a base structure which rests on the bed or bottom through its own weight.

Platforms of this type, or at least their underwater structure, are most often constructed of concrete thereby providing platforms which are very stable and withstand stresses and corrosion well The installations well generally placed on one or more decks which are supported on the top of one or more vertical elements of the platform, but may comprise a component, for example a lifting gear, supported directly by a post of the platform.

The platform may be constructed on land or near a shore and then be towed to its stationing site, where it is set in position. However the installations are also very heavy themselves and, for obvious reasons of stability, it can hardly be considered to tow the platform with heavy loads on the top of the vertical elements of structure. It is known, in particular from the Applicants' British Pat. No. 1,470,873, to keep the deck at the base of the vertical elements during towing. The structure is then ballasted on the stationing site so as to cause it to rest on the bottom and cause the deck to slide upwardly along these elements by mechanical means.

The present invention enables these mechanical raising means to be dispensed with.

SUMMARY OF THE INVENTION

According to the present invention there is provided a platform for supporting industrial or scientific installations above the surface of the water. The platform comprises a base structure designed to rest on the bottom of the sea or of a body of water. A hollow elongate element has a water-tight peripheral wall and water-tight lower end wall. Means temporarily fix the hollow elongate element to the structure. A deck or a support of a component of the installation is connectable to the elongate element. The base structure comprises a floatable device capable of keeping it afloat and includes means enabling the structure to be ballasted so as to install it on the bottom of the sea or of the body of water. At least one guide device on the base structure slidably supports the hollow elongate element which is vertically movable. The hollow elongate element forms a float capable of supporting at least part of the deck or the support above the water. The base structure further includes means enabling the elongate element to be immersed over at least the greater part of its height whereby the buoyancy of the elongate element may be adjusted. The deck and/or support is separate from the elongate element and includes means enabling it to float on the water until it is over the top of the elongate element. Securing means enable it to be fixed to the elongate element.

In a specific embodiment, the guide device comprises a hollow shaft fixed to the floatable device of the base structure. The hollow elongated element can slide telescopically in the hollow shaft. Means are then provided for temporarily keeping the hollow element completely plunged into the hollow shaft during the intake for immersing the structure, which can be achieved either simply by ballasting the element or with removable locking or fixing means. In the latter case, it is nevertheless necessary to ballast the hollow element when the structure is resting on the bottom in order to enable the removable locking or fixing means to be undone.

Another feature of the invention includes a base structure designed to rest on the bottom of a body of water having extensible means with an upper end and variable buoyancy being disposed thereon. The extensible means is mounted to move up and down with respect to the base structure. The base structure includes means for ballasting to cause the base structure to sink to the bottom of water at the stationing site. Means are provided to adjust the buoyancy of the extensible means to effect the up and down movement of the extensible means after the base structure rests on the bottom of the body of water. A floatable deck supporting means has a bottom which includes means for engaging the upper end of the extensible means after the deck supporting means is conveyed from a remote location of construction to a position over the upper end of the extensible means when the base structure is resting on the bottom of the body of water at the stationing site.

BRIEF DESCRIPTION OF DRAWINGS

The description which follows with reference to the accompanying drawings, given by way of example, will make it clearly understood how the invention can be carried into effect.

FIG. 1 is a diagrammatic view of a platform structure according to the invention floating on the water in the towing position;

FIG. 2 is a view on a larger scale of a detail surrounded by the circle II in FIG. 1;

FIG. 3 is a sectional view on the line III—III in FIG. 2;

FIG. 5 is a view similar to FIG. 1 showing the deck of the platform floating on the water at the side of the structure resting on the bottom of the sea;

FIG. 6 is a view similar to FIG. 5 showing the deck brought into position above the hollow elongated element which is designed to support it above the water;

FIG. 7 is a diagrammatic sectional view on the line VII—VII of FIG. 6;

FIG. 8 is a view similar to FIG. 6 showing the deck supported above the water;

FIG. 11 is a view similar to FIG. 5 showing an embodiment comprising two hollow elongated elements designed to support a deck and a crane, respectively;

FIG. 12 is a view similar to FIG. 8 showing the deck and the crane supported above the water;

DESCRIPTION OF SPECIFIC EMBODIMENTS

Figure 4:
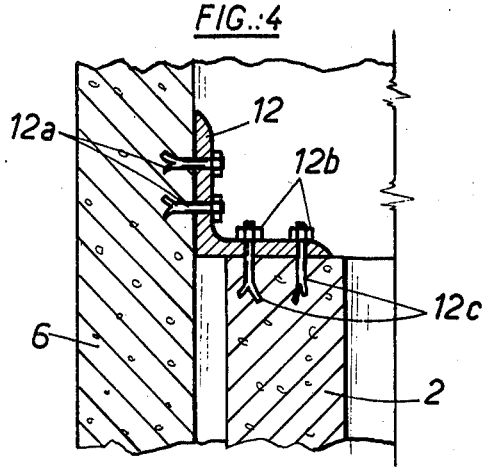
FIG. 4 is a view of a detail surrounded by the circle IV in FIG. 1.

In FIG. 1, a platform structure comprises a horizontal slab 1 fixed to a vertical hollow central shaft 2 having an open upper end. An annular caisson is fixed to slab 1 and surrounds central shaft 2 over a portion of its height. The annular caisson forms a float. Slab 1, hollow shaft 2, and annular caisson 3 are all constructed in concrete and shown only diagrammatically. The combined concrete construction includes elements (not shown) which ensure their bracing and, advantageously, partitioning of caisson 3 to divide it into water-tight compartments for ensuring the stability of the structure afloat. A water flow control system for caisson 3, represented diagrammatically, includes an electrical valve 4 and an immersed pump 5 having a suction pipe 5*a* and a delivery 5*b* opening externally. The water flow control system allows water to enter and to be discharged from caisson 3.

A hollow cylindrical element 6 made of concrete is mounted to slide vertically in hollow shaft 2. Element 6 comprises a water-tight peripheral wall 6*a* and is closed at the bottom and top by water tight ends or end walls 6*b* and 6*c*, respectively. Wall 6*a* includes three externally disposed rings 7, 8, 9 of projections vertically spaced with respect to each other. Projections 7*a*, 7*b* (FIGS. 2 and 3) of ring 7 jut out radially so far as the inner cylindrical surface 2*a* of hollow shaft 2 to ensure guiding of the sliding action. A flat metal ring 11 fixed by bolts 11*a* to the lower face of end 6*b* can slide with a slight clearance within the surface 2*a* for a purpose discussed below.

An angle-iron collar 10 is fixed by bolts 10*a* near the top of element 6 for a purposed discussed below. A second angle-iron collar 12 is fixed to the cylindrical element 6 by bolts 12*a*. Collar 12 may be temporarily secured to the top of hollow shaft 2 by nuts 12*b* screwed onto bolts 12*c* embedded in the concrete as shown in FIG. 4. A water flow control system for element 6, represented diagrammatically, includes an electric valve 13 and an immersed pump 14 having a suction pipe 14*a* and a delivery pipe 14*b* opening externally. The water flow control system allows water to enter and to be discharged from element 6.

The base structure described hereinbefore is intended to support a metal deck 15 carrying installations 16 above the surface S of the sea (FIG. 5). Deck 15 includes a hull or shell 17 capable of floating with the installations and having tunnel 18 on its underside for a purpose discussed below.

The base structure and deck 15 are constructed separately, and preferably at the same time, in a dock on land or near a shore and deck 15 is then equipped with the installations 16. In FIG. 1, caisson 3 is ballasted by a mass of water 19 so that the base structure floats at surface S if the sea. Element 6 rests at the bottom of hollow shaft 2 through its own weight and is fixed to hollow shaft 2 by the nuts 12*b* (see FIG. 4). The structure is towed in this state to the stationing site, at the same time as deck 15.

When the structure is over the stationing site, (FIG. 5) valve 4 is opened via remote control (by means not shown) to allow caisson 3 to fill with water, as shown at 19*a*. The filling is gradual, so that the structure settles gently on the bottom. During this operation, hollow element 6 projects above surface S of the water, ensuring the stability of the structure during immersion. When slab 1 is resting on bottom F, the valve 13 is opened via remote control (by means not shown) to allow entry into the hollow element 6 of a mass of water 20. Thus, element 6 sinks and rests on the bottom of hollow shaft 2, and nuts 12*b* are undone (state shown in FIG. 5). In this position, the top of hollow element 6 projects above surface S of the water by a height h.

The tunnel 18 of deck 15 (see FIGS. 6 and 7) has a height slightly greater than h above surface S of the water and a width very slightly greater than the diameter of element 6. Tunnel 18 leads to a cylindrical seat 21 located at the center of deck 15. Seat 21 has a height a little greater than h and is shaped to engage the top of element 6. Deck 15 is brought into the position shown in FIG. 6 by engaging tunnel 18 over the emergent end of element 6 until it is located in seat 21.

Pump 14 is then actuated (by means not shown) to remove a little of the water 20 to unballast element 6 until it applies itself against the far end of seat 21 and raises deck 15 a little above surface S. Collar 10 of element 6 is then fixed to the underside of deck 15 with bolts 10*b* (FIG. 8) and pump 14 is actuated again to bring deck 15 to the desired height above surface S of the water, for example about ten meters as shown in FIG. 8. Finally, hollow element 6 is fixed to hollow shaft 2 by pouring a mortar into the annular gap 22 between them. Flat ring 11 prevents the mortar flowing away at the base of gap 22.

Figure 10:
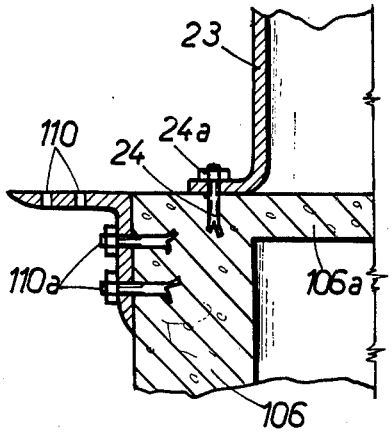
FIG. 10 is a view on a larger scale of a detail surrounded by the circle X in FIG. 9.
Figure 9:
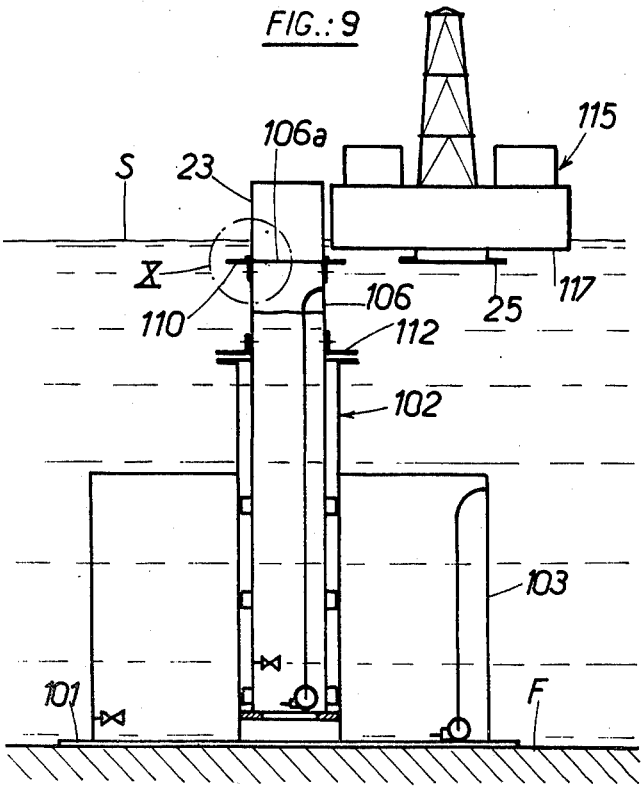
FIG. 9 is a view similar to FIG. 5 showing another embodiment of the hollow element.

FIGS. 9 and 10 show elements which perform the same functions as in the preceding Figures and are designated by the same reference numbers increased by 100 units. Hollow concrete element 106 has a lower height than element 6 and is completely immersed in the position shown when it is completely sunk into hollow shaft 102 and slab 101 is resting on the bottom of the sea at the stationing site. However, element 106 is extended well above surface S by a metal sleeve 23. This combination forms a float which projects very amply above surface S during immersion of the structure, thus ensuring its stability. Sleeve 23 is fixed to element 106 with nuts 24*a* screwed onto bolts 24 embedded in the concrete (FIG. 10).

When the structure is resting on bottom F, nuts 24*a* are undone and sleeve 23 s removed. Hull 117 of deck 115 therefore does not need to have a tunnel to enable deck 15 to be brought above the completely immersed element 106. Flange 25 is permanently fixed below hull 117. Collar 110 is applied below flange 25 and then fixed to flange 25 with bolts.

FIGS. 11 and 12 show elements that perform the same functions as in FIGS. 1 to 7 and are designated by the same reference numbers increased by 200 units. Hollow element 206 suppots deck 215. Additionally, the concrete structure comprises a second hollowshaft 26 in which a second hollow cylindrical element 27 slides vertically. Element 27 supports a crane 28 above the surface S of the water. Crane 28 is similar to the one described in U.S. Patent application Ser. No. 775,316 of Mar. 7, 1977. In FIG. 11, crane 28 is brought over element 27 by two floats 29, 30 forming a kind of catamaran with the platform 28*a* thereby supporting the latter above the surface S of the water.

FIGS. 13 to 16 show elements which perform the same functions as in FIGS. 1 to 7 and are designated by the same reference numbers increased by 300 units. Hollow element 306 supports deck 315 and is in the form of a hollow cylinder closed at the top and bottom by ends or end walls 306b and 306c. Sliding hollow element 306 carries an air-blow-off valve 31 close to upper end wall 306c. A water inlet valve is also carried at a certain distance below the surface S of the water. A valve 33 is disposed on lower end wall 306b and places the internal volume of element 306 in communication with the internal volume of shaft 302 via a siphon 33a and an emptying pump 314. Shaft 302 carries a valve 35 in its upper portion.

Figure 16:
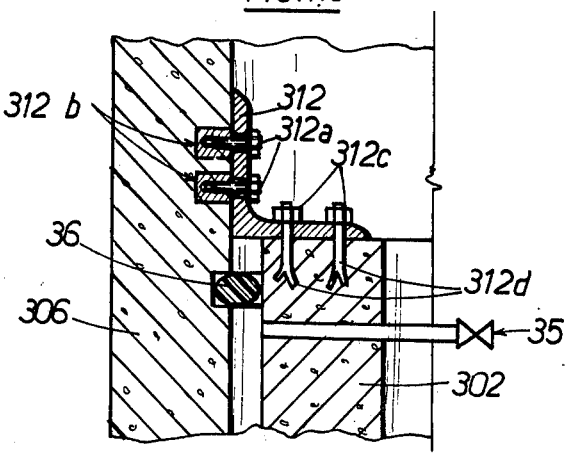
FIG. 16 shows the locking means in accordance with detail XVI of FIG. 13.
Figure 15:
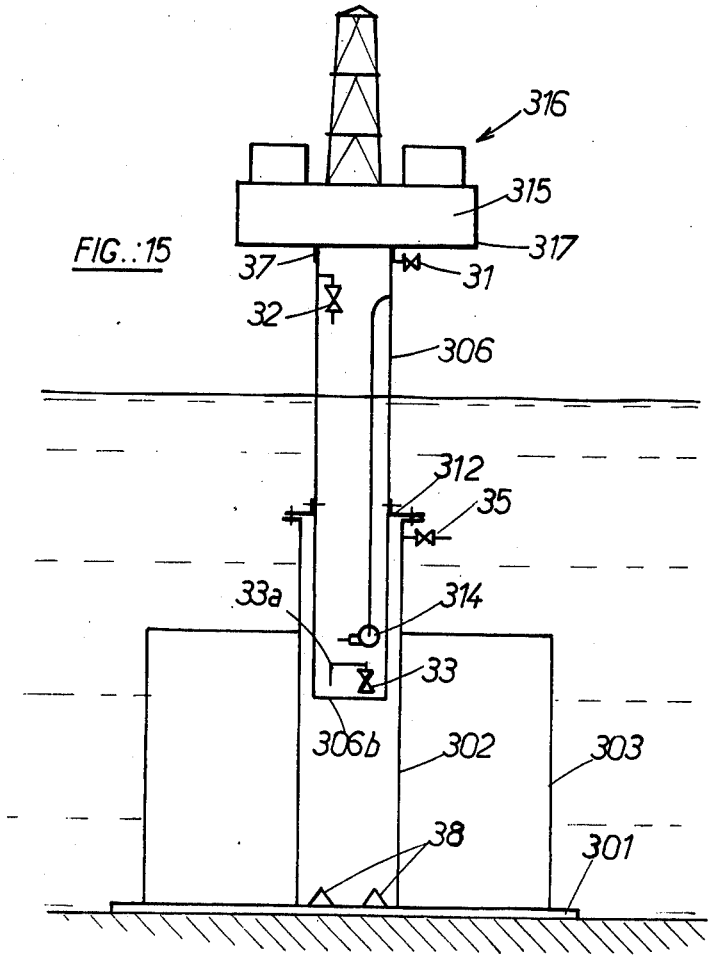
FIG. 15 is a view showing the placing of the deck in the high position before it is fixed.

The circled detail XVI represents the locking and sealing means for immobilizing hollow element 306 on shaft 302. FIG. 16 shows the said means on a larger scale. An angle-iron collar 312 is fixed to cylindrical element 306 with bolts 312a and to bushes 312b secured with hollow element 306. Collar 312 is also fixed to the top of hollow shaft 302 with nuts 312c screwed onto anchoring bolts 312d embedded in the concrete of shaft 302. An inflatable seal 36 ensures tightness between sliding element 306 and shaft 302.

The structure described above is intended to support a metal deck 315 (FIG. 14) carrying installations 316 above the surface S of the sea. Deck 315 has a hull 317 capable of supporting it afloat with installations 316. A centering device 37 is disposed below the bottom part of hull 317. The function of device 37 will be made clear hereinbelow.

Figure 13:
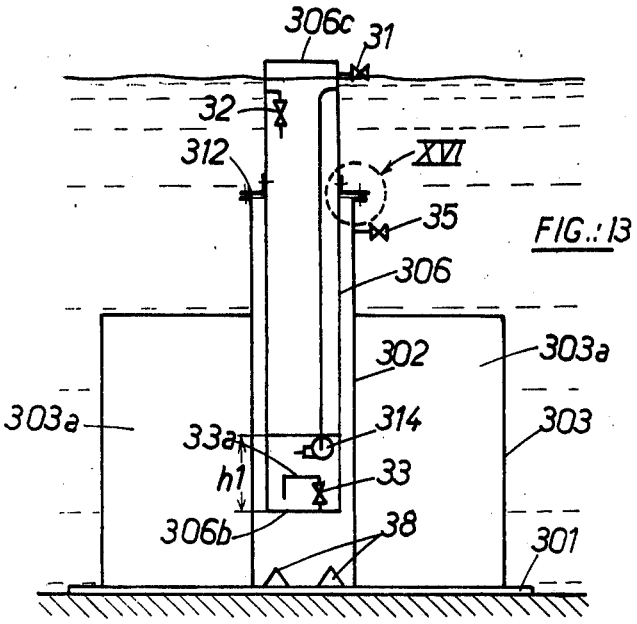
FIG. 13 is a view similar to FIG. 1 showing another embodiment of the hollow element.

After towing base 303 and shaft 302 over the site, hollow sliding element 306 disposed in shaft 302 is positioned in height (if this operation has not already been carried out before towing). The upper end of element 306 extends, for example, by 2 meters above the level of the highest astronomical tide taking account of the depth at which base 303 must rest. Valve 32 and the water outlet are kept closed while valve 33 is opened. The water-tight compartments 303a of caisson 303 are filled with water so as to carry out the immersion of the structure. That part of element 306 which extends beyond shaft 302 enables the immersion operation to be controlled even when the top of shaft 302 is immersed (FIG. 13). As soon as the structure touches the bottom, filling the compartments 303a entirely with water is completed.

Presentation of deck 315 is then carried out (FIG. 14). to bring deck 315 above element 306, element 306 is retracted into shaft 302 and caused to rest on blocks 38 located in the bottom slab 301. To bring it to this position, the following operations are effected:

Valve 32 is opened, valve 33 being still open, until the apparent weight of element 306 enables it to be supported on the locking means XVI. Element 306 fills with water to a height hl via siphon valve 33, 33a; the air trapped in element 306 escapes through blow-off valve 31, while the air trapped between end wall 306b and shaft 302 escapes through valve 35.

Valves 32 and 33 are then closed, the locking means XVI are disassembled by unscrewing nuts 312c and element 306 is still supported on the end of shaft 302.

Element 306 is lightened to cause it to rise by a small height, for example 10 cm (by pumping out a small amount of water via pump 314).

The locking means 312a and 312 and seal 36 are dismantled.

Figure 14:
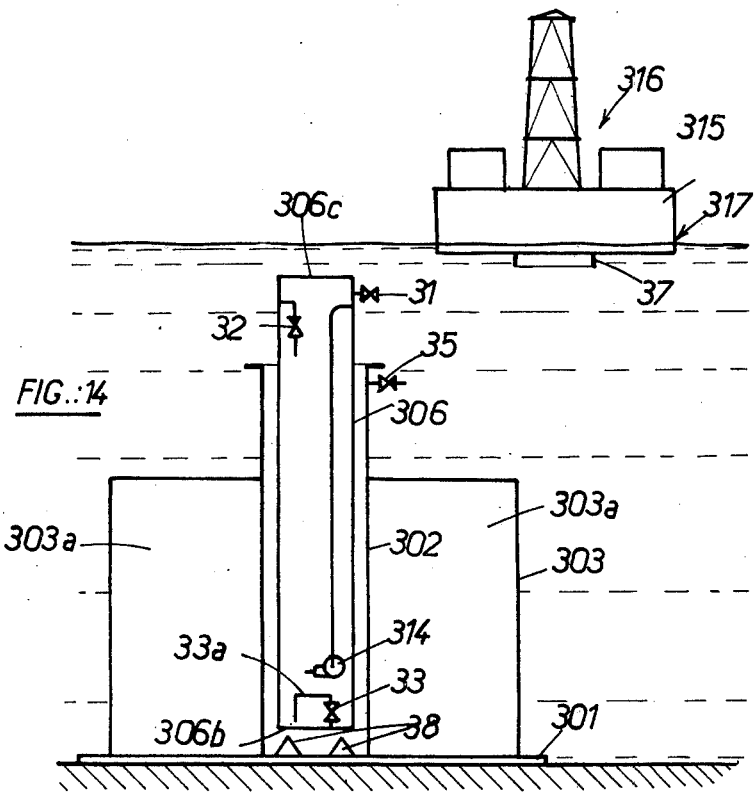
FIG. 14 is a view similar to FIG. 13 showing the deck of the platform floating on the water at the side of the structure resting on the bottom of the sea.

Water is then introduced into sliding element 306 by reopening valve 32. Element 306 descends in shaft 302 and comes into abutment with support blocks 38 formed by shock absorbers fixed to slab 301 at the foot of shaft 302 (FIG. 14).

The top of element 306 is then at such a depth with respect to the level of the sea that deck 315 can be brought into perpendicular alignment therewith without the centering device 37 coming into contact with element 306. The distance between the top of element 306 and the edge of centering device 37 is taken as equal to 1 meter.

LIghtening of element 306 is then carried out via pump 314. Element 306 rises and locates itself in centering device 37. Deck 315 is fixed to sliding element 306 which is then completely emptied. The buoyancy then acts on element 306 and carried deck 315 above the level of the sea. The buoyancy is calculated so that the level reached by deck 315 is above the final level. The locking means XVI are placed in position on sliding element 306 at a lower level. An amount of water sufficient is introduced into element 306 for the locking means to rest on the edge of shaft 302 where they are locked again. A concrete grout can then be injected between sliding element 306 and the wall of shaft 302 if the platform is permanent. If the platform is to be retrieved subsequently, it will be advantageous to replace the bedding by seals by providing suitable seats in the wall of shaft 302 or of sliding element 306.

It will be apparent, that the embodiments described have been given only by way of example and that they could be modified, in particular by substituting technical equivalents, without thereby departing from the scope of the present invention. In particular, there would not be any departure from the scope of the invention by omitting the upper end wall 6c so that the top of the hollow element is open to the open air.

Instead of using a single hollow elongated element such as 6 acting at the center of the deck for raising and supporting it, it would be possible to use a plurality of hollow elongated elements, for example three elements arranged at the vertices of an equilateral triangle.

We claim:

1. A platform for supporting industrial or scientific installations at the surface of a body of water, comprising:

(a) a base structure designed to rest on the bottom of the sea or of a body of water;

(b) a hollow elongate element having a water-tight peripheral wall and water-tight lower end wall;

(c) locking means for temporarily fixing said hollow elongate element to the structure;

(d) supporting means for a part of a deck or a component of said installation, (e) said base structure including a floatable device capable of keeping it afloat, means enabling the structure to be ballasted so as to install the base structure on the bottom of the sea or of the body of water; and at least one guide device in which the hollow element can slide vertically;

(f) a float capable of supporting at least part of said supporting means above the water;

(g) means enabling said hollow element to be immersed over at least the greater part of its height whereby the buoyancy of said hollow element may be adjusted, (h) said supporting means being separate from said hollow element and including means enabling said supporting means to float on the water until they are over the top of said hollow element, and (i) means enabling said supporting means to be fixed to said hollow element.

2. A platform according to claim 1 wherein the guide device includes a vertical hollow shaft in which the hollow elongated element can slide telescopically, and further including means enabling said elongate element to be kept temporarily lowered as far as possible into said hollow shaft during the intake of water into the base structure for immersing the base structure.

3. A platform according to claim 2, wherein a plurality of projections are located on the outer surface of said hollow elongate element, said projections being capable of sliding on the inner surface of said hollow shaft, and a gap is located between the two surfaces for receiving mortar for fixing said element to said hollow shaft.

4. A platform according to claim 1 wherein said supporting means includes a hull enabling it to float on the water, a seat in a central position and adapted to receive the top of the elongate element, and a radially directed tunnel leading to said seat.

5. A platform according to claim 1 wherein said hollow elongate element includes a watertight upper end wall and is completely immersed when it is lowered as far as possible into said guide device and said base structure is resting on the bottom of the sea or of the body of water at the stationing site, and further including an additional float which projects above the surface of the water and means for temporarily fixing said additional float to the top of said elongate element.

6. A platform according to claim 1, wherein the height of said sliding elongate element when it is retracted into the guide device is such that the top of the element is at a level lower than that of the bottom of the floating supporting means.

7. A platform according to claim 6, wherein locking and sealing means are provided for maintaining the sliding elongate element on the top part of the guide device.

8. A platform according to claim 6 wherein said supporting means has a centering device at the bottom thereof for receiving the top end of the sliding elongate element.

9. A platform according to claim 6 wherein the sliding elongate element comprises on its watertight lower end wall a siphon valve placing the internal volume of the sliding elongate element in communication with the internal volume of the hollow guide device, and at the top, an air blow-off valve and a valve placing the internal volume of the sliding elongate element in communication with the outside.

10. A platform according to claim 6 wherein a valve is disposed at the upper end of the guide device placing the annular space between the guide device and the sliding element in communication with the outside.

11. A method of constructing and placing in position a platform according to claim 1, said method comprising the steps of:

(a) constructing separately on land or near a shore, the base structure and a deck provided with a float capable of keeping it afloat, (b) towing them to the stationing site, (c) ballasting the base structure so that it rests on the bottom, (d) ballasting the hollow elongate element so that the top thereof is nearly level with the surface of the water, (e) bringing the deck floating on the water above the hollow elongate element, (f) unballasting the hollow elongate element so as to raise the deck above the water, and (g) fixing the hollow elongate element to the deck and to the base structure.

12. A method of constructing and placing in position a platform according to claim 6, said method comprising the steps of:

(a) constructing separately on land or near a shore, the base structure and a deck provided with a float capable of keeping it afloat, (b) towing them to the stationing site, (c) fixing the sliding elongate element so that when the base structure is immersed, the upper end of the sliding elongate element is above the level of the water, (d) ballasting the base structure so that it rests on the bottom, the guide device and the sliding elongate element being empty, (e) then ballasting the sliding elongate element so that it rests on the locking means, (f) disassembling the locking means, (g) filling the guide device and the sliding elongate element with water so that the sliding elongate element comes into abutment at the bottom of the guide device, (h) bringing the deck above the sliding element, (i) partially emptying the sliding elongate element to bring the end of the said elongate element and the deck into position, (j) fixing the deck to the sliding element, (k) completely emptying the sliding elongate element to cause the deck to ascend, (l) placing the locking means in position, (m) ballasting the element so that the locking means come into contact with the end of the guide device, and (n) fixing the sliding element to the guide device.

13. A platform according to claim 1, wherein there are a plurality of such elongate elements with corresponding guide devices on the base structure.

14. A method according to claim 11, wherein there are a plurality of such elongate elements with corresponding guide devices on the base structure and further including the operations of ballasting each element so that their tops are nearly level with the surface of the water, bringing the deck floating on the water over the hollow elongate elements, unballasting the hollow elongate elements and fixing the hollow elongate elements to the deck and to the base structure.

15. A platform having a base structure and a deck supporting means for supporting industrial or scientific installations at the surface of a body of water, said platform comprising:

(a) a base structure designed to rest on the bottom of a body of water, (b) extensible means having an upper end and variable buoyancy, (c) means disposed on the base structure for movably mounting said extensible means, (d) said base structure including means for ballasting to cause the base structure to sink to said bottom, (e) means for adjusting the buoyancy of the extensible means to move said extensible means up and down with respect to the base structure, (f) deck supporting means including a bottom and being floatable apart from said base structure and extensible means, and (g) means for engaging the upper end of the extensible means with the bottom of the deck supporting means.

16. A platform according to claim 15, wherein the extensible means is immersed over at least a greater portion of its mass to be buoyant, said movably mounting means includes means for temporarily fixing the extensible means to the base structure to prevent movement thereof.

17. A platform according to claim 15, wherein the extensible means is effective to hold water, and said buoyancy adjusting means includes means for introducing water to and discharging water from the extensible means to vary the buoyancy of the extensible means.

18. A platform according to claim 15, wherein the bottom of the deck supporting means has a shape to allow the deck supporting means to float to a position over the upper end of the extensible means.

19. A platform according to claim 15, wherein the engaging means includes means to fix the deck supporting means in position at the upper end of the extensible means.

20. A platform according to claim 19, wherein said deck supporting means is fixed directly to the extensible means.

21. A method of locating a platform having a base structure and a deck supporting means for supporting industrial or scientific installations at the surface of a body of water, said method comprising:

(a) constructing a floatable base structure at a first location, (b) said base structure being designed to rest on the bottom of said body of water at a stationing site at a second location, (c) moving the floating base structure from the first location to said stationing site, (d) ballasting the base structure to cause it to rest on said bottom at the stationing site, (e) said base structure including an extensible means having an upper end and being movable up and down with respect to the base structure, (f) constructing a floatable deck supporting means at a location remote from said stationing site, (g) said deck supporting means having a bottom structure effective to engage the upper end of the extensible means, (h) conveying the floating deck supporting means from said remote location to the stationary site over the upper end of the extensible means, and (i) moving the extensible means upwardly to engage the bottom of the deck supporting means and rigidly support the deck supporting means at the surface of the body of water.

* * * * *